United States Patent [19]

Zajac, Jr.

[11] Patent Number: 5,019,872

[45] Date of Patent: May 28, 1991

[54] CONTINUOUS-FORM ELECTROPHOTOGRAPHIC PRINTER

[75] Inventor: Theodore Zajac, Jr., Spokane, Wash.

[73] Assignee: Output Technology Corporation, Spokane, Wash.

[21] Appl. No.: 535,112

[22] Filed: Jun. 8, 1990

[51] Int. Cl.[5] ..... G03G 21/00

[52] U.S. Cl. ..... 355/317; 226/75; 355/274; 355/282; 355/311

[58] Field of Search ..... 355/274, 317, 282, 308, 355/311, 271, 309, 203, 204, 208; 226/74, 75

[56] References Cited

U.S. PATENT DOCUMENTS

| | | | |
|---|---|---|---|
| 3,987,884 | 10/1976 | Buxton | 226/74 X |
| 4,478,508 | 8/1984 | Kato et al. | 355/317 |
| 4,595,279 | 6/1986 | Kuru et al. | 355/282 |
| 4,607,572 | 8/1986 | Pou et al. | 355/317 |
| 4,609,279 | 9/1986 | Hausmann et al. . | |
| 4,843,429 | 6/1989 | Avritt et al. | 355/274 |
| 4,844,434 | 7/1989 | Acquaviva et al. | 355/308 X |
| 4,870,434 | 8/1989 | Negishi et al. | 346/160 |
| 4,943,863 | 7/1990 | Ainoya | 355/271 |

OTHER PUBLICATIONS

Laser Printer User's Guide, "Pentax Teknologies Laserfold 240", Pentax Teknologies Corporation, Broomfield, Colo., Rev. 05 (Jan. 30, 1990).

*Primary Examiner*—A. T. Grimley
*Assistant Examiner*—Thu A. Dang
*Attorney, Agent, or Firm*—Wells, St. John & Roberts

[57] ABSTRACT

A preferred embodiment of this continuous-form electrophotographic printer as illustrated in the drawings having an image transfer device 38 positioned at the image transfer station for placing images on individual sheets 14 of a continuous-form 12. Downstream, a distance A, is a fixing device at an image fixing station 32 for fixing the image onto the individual sheet 14. The printer 10 includes a control means 76 for moving the continuous sheet forward when a stop signal is received to position a leading edge of a sheet at the image fixing station 32. When a restart signal is received, the control system initiates the continuous-form feeding means 38 to move the continuous-form 12 forward until a leading edge of a succeeding sheet is positioned at the image transfer station.

20 Claims, 4 Drawing Sheets

CONTINUOUS-FORM ELECTROPHOTOGRAPHIC PRINTER

TECHNICAL FIELD

This invention relates to continuous-form electrophotographic printers.

BACKGROUND OF THE INVENTION

There presently exists a number of continuous-form electrophotographic printers. However, one of the perplexing problems is to be able to provide such a continuous-form electrophotographic printer that is capable of printing continuous-forms having various sheet length sizes without damaging the printing when movement of the continuous-form is stopped and then restarted.

Generally, the continuous-form electrophotographic printers are constructed so that the image fixing station is spaced downstream from the image transfer station by the standard sheet length, such as eleven inches. Consequently, the spacing between the image transfer station and the image fixing station is dependent upon the standard length of the sheets forming the continuous-form. Such equal length spacing enables both the image transfer device and the fuser device to be positioned in "no print zones" over a leading edge or perforations when movement is stopped. Otherwise, the heat from the fuser would damage unfused images in the zone between the image transfer device and the fuser device. Upon restarting, the damaged sheet will proceed with the flow without the controlling computer being cognizant that one of the sheets is damaged. When damaged sheet is finally discovered provisions must be made to print a new sheet with undamaged printing.

As mentioned, the present arrangement of the spacing being equal to the sheet length works quite well for a standard page or sheet length, but causes damage to sheets of a continuous-form that is not of a standard length.

One suggestion to overcome such a problem is to provide an electrophotographic printer in which the spacing between the image transfer station and the image fixing station is adustable to vary the distance therebetween to equal the length of the sheet of the continuous-form. Such a solution is rather expensive in that it requires very accurate and complicated support systems for being able to support and adjustably move one or both of the device.

One of the advantages of this invention is to provide a continuous-form electrophotographic printer that is capable of printing various length sheets of a continuous-form without having to move the image transfer station or the image fixing station relative to each other to prevent damage.

These and other obvious advantages of this invention will become apparent upon reading the following detailed description of a preferred embodiment.

BRIEF DESCRIPTION OF THE DRAWINGS

The preferred embodiment of the invention is illustrated in the accompanying drawings, in which:

FIG. 5 is a schematic isometric view similar to FIG. 4 except showing the restarting of the movement of the continuous-form with a leading edge of a sheet registered at the image transfer station; and FIG. 6 is a schematic block diagram illustrating a control circuit for the printer.

DETAILED DESCRIPTION OF THE PREFERRED EMBODIMENTS

The following disclosure of the invention is submitted in furtherance with the constitutional purpose of the patent laws "to promote the progress of science and useful arts" (Article, 1, Section 8).

Figure 1:
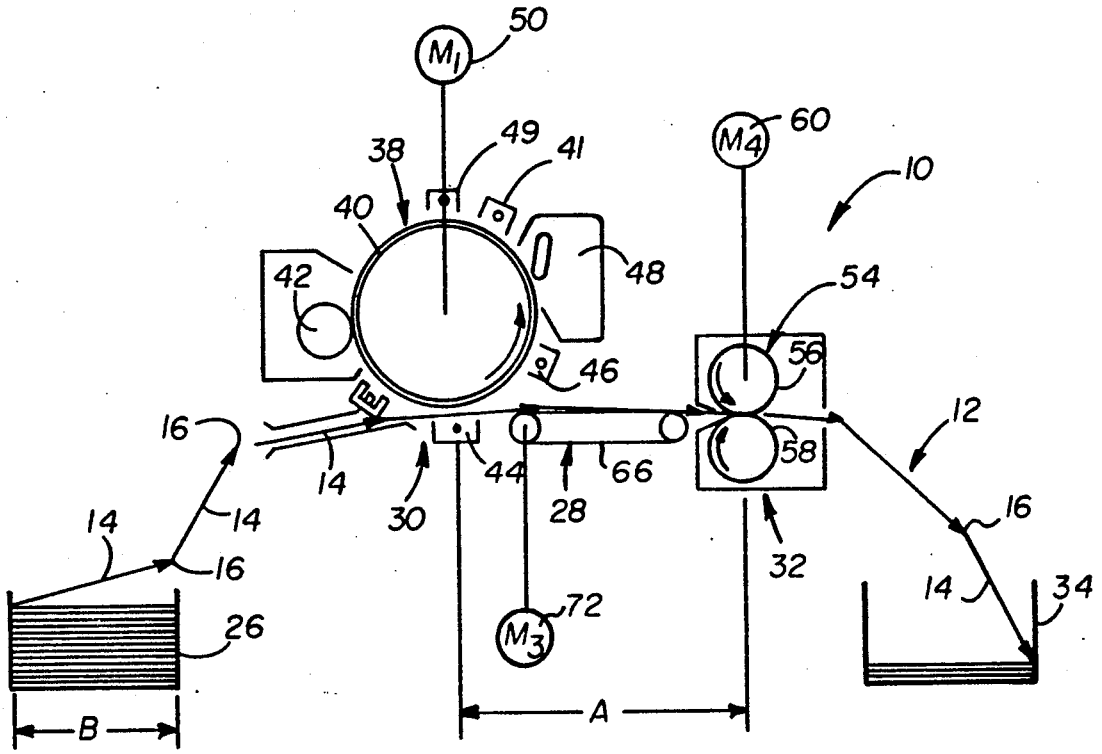
FIG. 1 is a side elevation schematic of a preferred embodiment of a continuous-form electrophotographic printer of the present invention illustrating the continuous-form being initially conveyed past an image transfer station and then past an image fixing station to print images onto individual sheets of the continuous-form.

A preferred embodiment of the xerographic or electrophotographic printer is shown in schematic form as numeral 10 in FIG. 1. The printer 10 is designed to be able to print on a continuous-form 12. Preferably the continuous-form 12 is of the "fan-folded" type having individual sheets that are interconnected at leading edges and trailing edges to form the continuous-form 125. In FIG. 1, each individual sheet of the continuous-form 12 is depicted by an arrow 14. Each individual sheet 14 has a non-standard sheet length or distance B between the leading edge and the trailing edge, e.g. less than eleven inches or greater than eleven inches. The individual sheets 14 are interconnected at an intersheet boundary 16. Preferably, the intersheet boundary 16 is defined by end perforations that enable each sheet 14 to be readily separated from the adjacent sheet of the continuous-form 12 after the printing has been accomplished. Additionally, the intersheet boundary 16 defines the leading edge of one sheet and the trailing edge of a preceding sheet.

As previously mentioned, the continuous-form 12 is preferably of the "fan-folded" type in which each of the individual sheets 14 has side sections 20 with feed perforations or holes 22 formed therein to facilitate accurate movement of the continuous-form 12 relative to the printer 10. Preferably each of the sheets 14 has side separation perforations 24 for enabling the side sections 20 to be separated from the side of individual sheets at the conclusion of the printing process.

FIG. 1 illustrates an unprinted storage means or container 26 for initially storing a continuous-form 12 before and during the feeding of the continuous-form through the printer 10. The printer 10 has a continuous-form feeding means generally designated with the numeral 28 for feeding the continuous-form 12 initially past an image transfer station 30 and then past a downstream image fixing station 32. The stations 30 and 32 are spaced by an interstation distance A that is different than distance B. Generally the distance A equals a standard sheet length such as eleven inches. The printer 10 may include a post-printer storage means 34 that collects the fan-folded printed continuous-form 12.

The printer 10 has an image transfer device 38 (FIG. 1) at the image transfer station 30 for transferring an image from an optical photo conductor (OPC) transport or drum 40 onto the individual sheets 14. The optical photo conductor drum 40 preferably includes photo receptors for producing a electrostatic image on the outer periphery of the drum from an image generator 41, such as a laser or array of LED's. The peripheral portion of the drum 40 passes a developer or toner applicator 42 for placing a toner or dry ink material on the drum 40 to form a toner image. An image formation device 44 is located at the image transfer station 30, opposite the drum 40 for transferring the toner image from the drum 40 to the sheets 14 as the drum 40 is rotated and as the sheets 14 pass the image transfer station 30.

The image transfer device 38 further includes charge eliminating electrode 46 that is downstream of the path of the drum 40 for discharging the photo receptors subsequent to the transfer. A drum cleaning unit 48 is positioned further downstream of the movement of the circular drum 40 to remove any excess or remaining toner or dry ink to prepare the drum 40 for a new image. A charging electrode 49 is generally utilized downstream of the drum cleaning unit for recharging the photo receptors.

The image transfer device 38 further includes a drum drive generally designated with the numeral 50 for rotating the drum 40 to bring the electrostatic latent image into position opposite the image formation means 44 to transfer the latent image to the individual sheets 14.

The printer 10 includes a fixing device 54 at the image fixing station 32 for fusing the toner or dry powder to the individual sheets 14 to complete the printing process. In the preferred embodiment, the fixing device includes a heat roller 56 that is heated to a temperature sufficient to fuse the toner as the sheets pass through the image fixing station. In conjunction with the heat roller 56, a pressure roller 58 is provided for pressing the continuous-form firmly against the heat roller 56 to increase the heat conductivity from the heat roller 56 to the sheet material as well as assisting in feeding the continuous-form 12 through the printer 10. The fixing device 54 includes a roller drive 60 that is connected to the heat roller 56 and/or the pressure roller 58 for rotating the roller 56, 58 in coordination with the movement of the continuous-form 12 through the image fixing station 32.

The continuous-form feeding means 28 further includes feed tractor 66 that are positioned intermediate the image transfer station 30 and the image fixing station 32 for moving the continuous-form 12 through the printer 10. Preferably, each tractor 66 includes a drive belt 68 with drive pins 70 that project into the feed perforations or holes 22 in the sheets 14 for moving the continuous-sheet precisely through the printer. The tractors 66 are driven by a tractor drive 72.

The printer 10 further includes a printer controlling means 76 preferably in the form of a microprocessor controller 77 for controlling the printer operation and particularly the operation of the continuous-form feeding means 28 and the drum drive 50 as illustrated in block diagram form in FIG. 6. Alternatively, the printer control means 76 may be an integral part of a controlling computer.

The printer controlling means 76 includes a sheet size input device 78 that is normally mounted on a front panel of a housing of the printer to enable the operator to enter the sheet size dimension (distance B) into memory of the microprocessor 77. Alternatively, the information (distance B) may be supplied by a computer that is operatively attached to the printer or by a sheet length measuring system similar to the one shown and described in the Kusatsu U.S. Pat. No. 4,478,508.

Additionally, the printer controlling means 76 includes a front edge detector 80 illustrated in dotted line in FIGS. 2–5 for detecting the front edge of the continuous-form when the continuous-form is initially fed into the printer 10. When the front edge detector 80 senses the front edge of the continuous-form 12, such location information is supplied to the controller 77 for operating the continuous-form feeding means 28 during the initial infeeding of the continuous-form and initial registration of the sheets 14 relative to the stations 30 and 32.

As illustrated in FIG. 6, the controller 76 includes a printing control section 82 for controlling the printer during normal operation in which the continuous-form is progressively and continuously fed through the printer in synchronization with the rotation of the drum 40 to successively print the sheets 12. Additionally, the controller 76 includes a sheet registration section 84 for initially registering or indexing the continuous-form 12 to align a leading edge of a sheet 14 with either the image transfer station 30 or the image fixing station 32. In controlling the various drives, the controller 76 interfaces through a drum control I/O device 86 to the drum drive 50 and through the continuous-form drive I/O device 88 to the tractor drive 72 and the fixer roller drive 60.

The printer controlling means 76 with a microprocessor 77, has a control processing unit, programmed memory and data memory for making registration computations.

The normal operation of the printer will not be discussed in any great detail other than that portion that deals with the feature of being able to utilize continuous-forms having sheets of different size than the spacing (distance A) between the drum 40 (image transfer station) and the fixer roller 56 (image fixing station 32). The normal operation of both image transfer device 38 and the fixing device 54 is well known.

A major feature of this invention is concerned with the stopping and restarting of the movement of the continuous-form without print damage in which each of the sheets 14 of the form 12 are of a length (distance B) different than the station spacing (distance A). For purposes of discussion, the length of the individual sheet is defined by distance B as illustrated in the drawings. Traditionally a stop signal is received by the printer at the completion of printing of a desired number of documents or when the memory of the control means 76 is overloaded. Traditionally with standard sheet lengths (such as eleven inches), the continuous-feed stops the continuous-form 12 with a leading edge of a sheet being aligned at the image transfer station 30 so that, upon restarting, registration of the continuous sheet with respect to the drum 40 is maintained. However, when utilizing continuous-form having sheets 14 of a length different than the distance A, the fixer roller is positioned intermediate a leading edge and a trailing edge of a preceding sheet usually causing a misprint on the sheets at the image fixing station 32.

Figure 2:
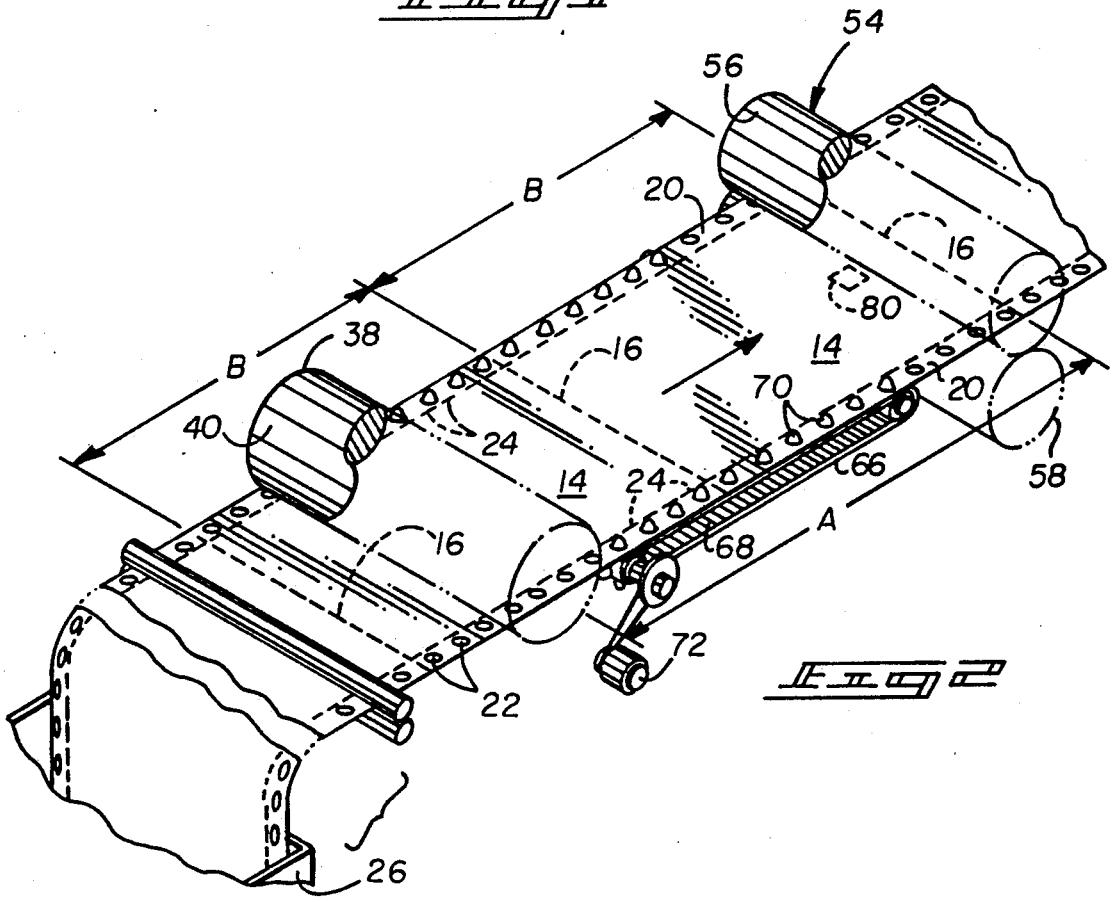
FIG. 2 is a schematic isometric view illustration an initial registration of the continuous-form with a leading edge of a sheet registered at the image fixing station.
Figure 3:
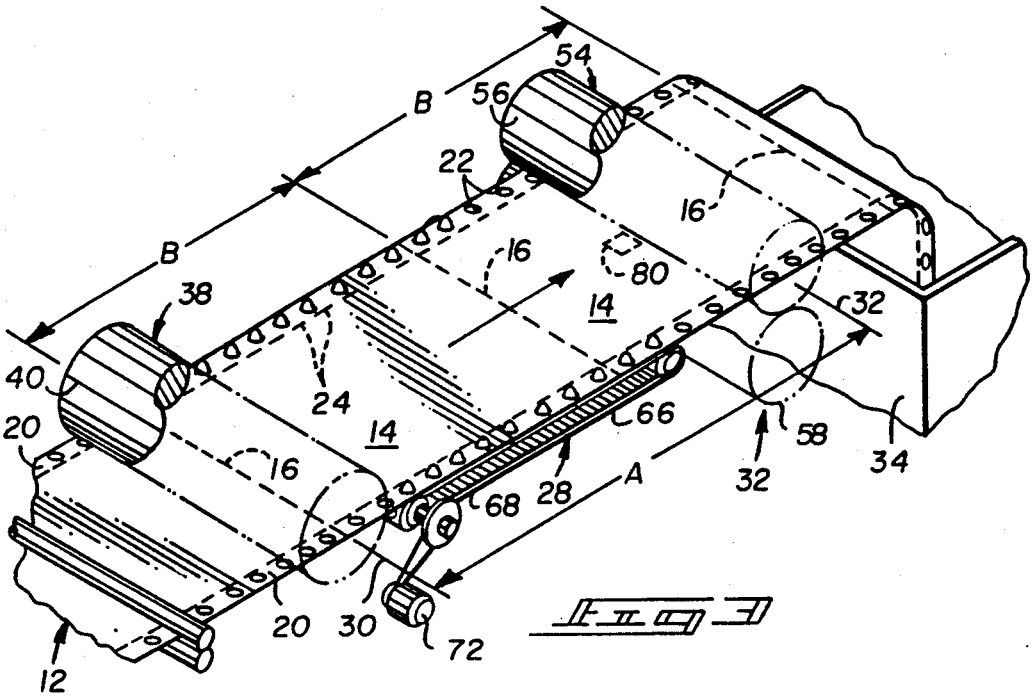
FIG. 3 is a schematic isometric view similar to FIG. 2 except showing an initial registration with a leading edge of a sheet registered at the image transfer station prior to printing.

During the initialization phase, in which a continuous-form 12 is first fed to the printer 10, the continuous-form feed means 28 moves the continuous-form forward until the front edge is sensed by the sensor 80. The controller 76 then causes the feed means 28 to index the continuous-form forward until a leading edge 16 is registered with the image fixing station as illustrated in FIG. 2. Then, the controller 76 causes the feed means 28 to index the continuous-form forward again, a distance sufficient to register the leading edge 16 of a succeeding sheet 14 at the image transfer station 30 as illustrated in FIG. 3. Normal printing then proceeds with the leading edge of each printed sheet being registered with the drum 40 utilizing normal printing section 82.

The printer controlling means 76, upon receiving a stop signal controls the sheet registration section 84 to index the sheets 14 forward a stopping distance C to register a leading edge 16 of a sheet 14 at the image fixing station so that the hot fixing roller 56 engages an intersheet boundary 16 or "no print zone". Such stopping distance C is calculated by subtracting nB from the distance A. The formula is as follows:

$$C=A-nB$$

in which n is a whole integer of the distance A divided by the distance B. If the length of the sheet (distance B) is greater than the spacing between stations 30 and 32, then n=0 with C=A.

Figure 4:
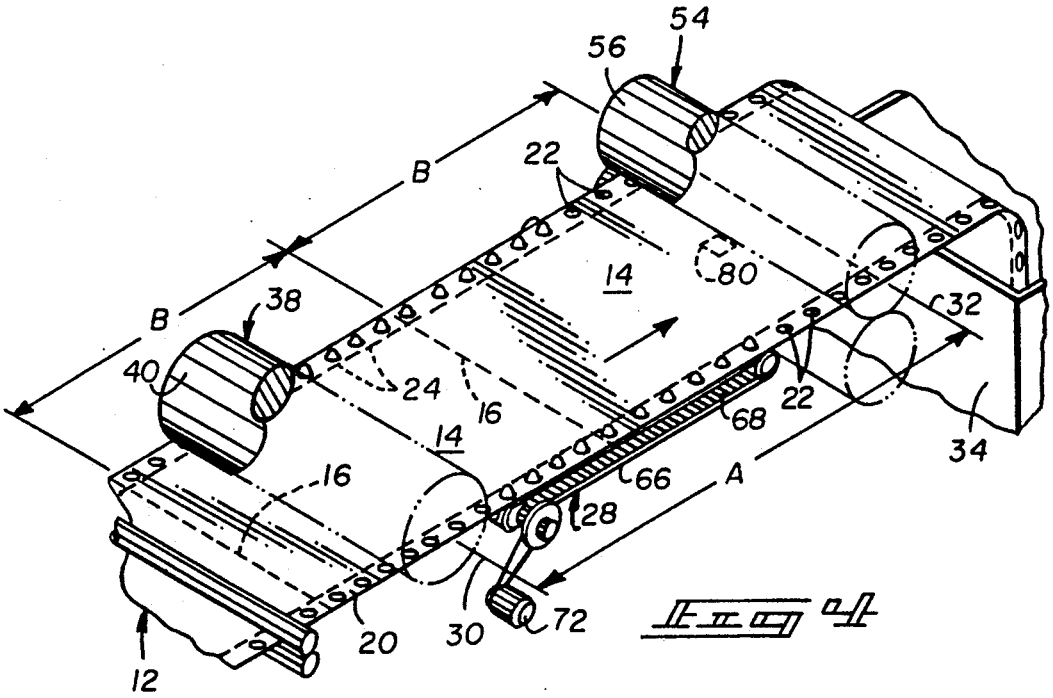
FIG. 4 is a schematic isometric view similar to FIG. 2 except showing the stopping of the movement of the continuous-form with a leading edge of a sheet registered at the image fixing station.
Figure 3:
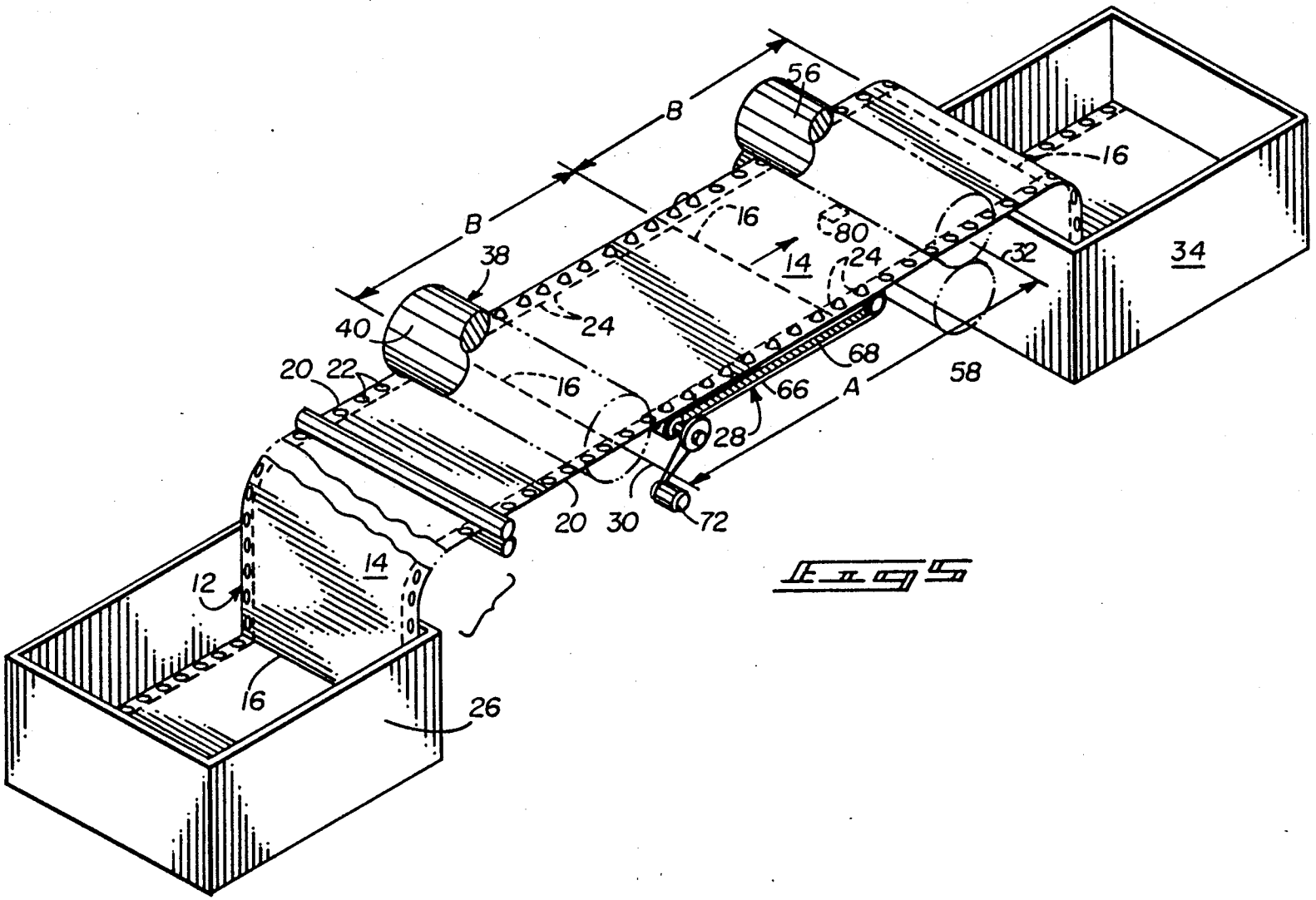
Figure 4:
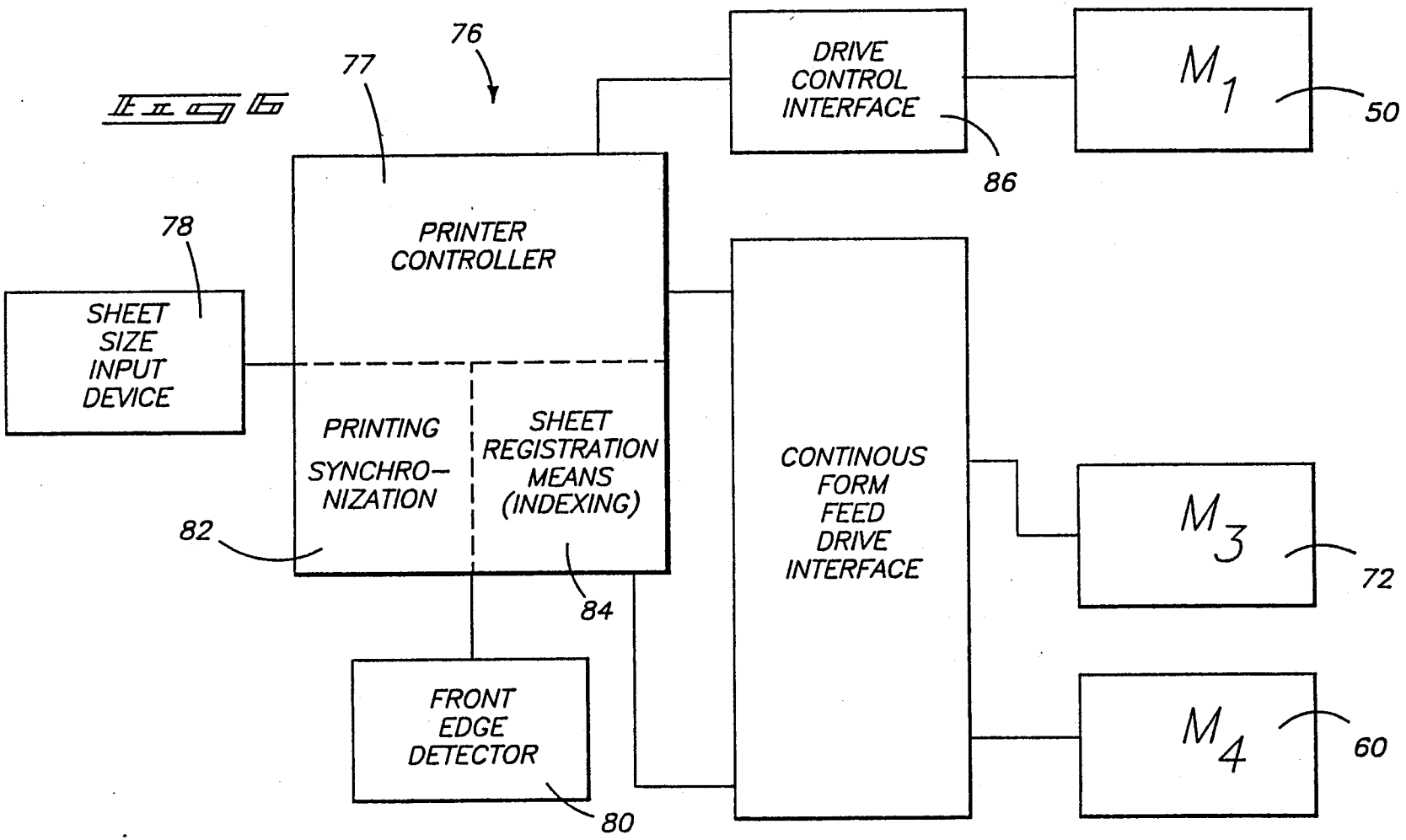

For example, if the distance between the image transfer station 30 and the image fixing station 32 is a standard eleven inches and the length of a sheet 14 (distance B) is eight inches, then the sheet registration means 84 operates the continuous-form feeding means 28 to index continuous-form 12 forward three inches to register or align a leading edge 16 of a sheet 14 at the image fixing station 32 as illustrated in FIG. 4. In this example, the whole integer n equals one ($11\div8=1$) and the formula $C=A-nB$ provides $C=11-(1)8=3$.

In a second example, assuming that distance A equals eleven inches and the sheet length is four inches (distance B equals 4) then the sheet registration means 76 causes the continuous-form feeding means 28 to index the continuous-form forward three inches so that the continuous-form stops with a leading edge 16 registered at the image fixing station 32. In this example, it should be noted than n=2 ($11\div4=2$). Using the formula, $C=A-nB$; then $C=11-(2)(4)=3$.

In a third example, assuming the distance A equals eleven inches and the sheet length is fourteen inches, then the continuous-form feeding means 28 indexes the continuous-form forward a distance of eleven inches so that the continuous-form stops with a leading edge 16 registered at the image fixing station 32. In this example, B is greater than A, with n=O. Using the formula, $C=A-nB$; then $C=11-(0)14=11$ inches.

When the printer controlling means 76 receives a signal to restart printing, then the sheet registration section 84 automatically causes the feed means 28 to index the continuous-form 12 forward a distance D to register a leading edge 16 of a sheet 14 at the image transfer station 30 rather than the image fixing station 32. Preferably, such registration or indexing is accomplished utilizing the calculations based on the formula of:

$$D=B-(A-nB) \text{ or } D=B-C,$$

in which n equals the whole integer of the distance A divided by the distance B. If B is greater than A, then n=O and D=B−A or B−C.

Such indexing is referred to as restarting registration after the continuous sheet has been stopped and prior to restarting printing.

In one example, assuming that distance A equals eleven inches and the sheet length (distance B) equals eight inches, then the continuous-form is indexed forward five inches to register a leading edge at the image transfer station. In this example, n=1 and $D=8-(11-2\times5)=5$.

In a second example in which A equals eleven inches and B equals four inches, then the sheet registration system means 84 causes the feed means 28 to index the sheet 14 forward one inch to align or register a leading edge 16 of a succeeding sheet 14 at the image transfer station 30. In this example, n=2 and $D=4-(11-2\times4)=1$.

In a third example, assuming the distance A equals eleven inches and the sheet length (distance B) equals fourteen inches, then the sheet registration means 84 causes the feed means 28 to index the sheet forward three inches to register a leading edge of the succeeding sheet 14 at the image transfer station 30. In this example, M=0 and $D=14-(11-0\times14)=3$ inches.

Applicants has found that when utilizing such a system, only one sheet is lost or unused when going through the sequence of printing, stopping and then restarting printing without losing data or destroying an already printed form which would have to be reprinted.

After the restarting registration procedure is accomplished as illustrated in FIG. 5, then normal printing is resumed in which the drum drive 50 and the feed means 28 are operated in synchronization with the leading edge 16 of each printed sheet being registered with the image transfer station.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

What is claimed is:

1. A continuous-form electrophotographic printer for printing a continuous-form composed of a series of interconnected individual sheets each having a sheet length B between a leading edge and a trailing edge, said printer comprising:

sheet feeding means for conveying the continuous-form initially past an electrophotographic image transfer station and then past an image fixing station;

said image fixing station being spaced downstream of the image transfer station by a preset sheet movement distance A that is different from the sheet length B;

an image transfer device at the image transfer station for transferring electrophotographic images onto the individual sheets as the continuous-form is conveyed past the image transfer station;

an image fixing device at the image fixing station for fixing the transferred images to the individual sheets as the continuous-form is conveyed past the image fixing station; and printer control means operatively connected to the sheet feeding means having a sheet registration means that is responsive to the distance A and B and to stopping and restarting of movement of the continuous-form for (a) indexing the continuous-form relative to the image fixing station to register a leading edge of a sheet with the image fixing station when the continuous-form is stopped, and (b) indexing the continuous-form relative to the image transfer station to register a leading edge of a sheet with the image transfer station when movement of the continuous-form is restarted.

2. The continuous-form electrophotographic printer as defined in claim 1 wherein the sheet registration means indexes the continuous-form forward a stopping distance C that is equal to the difference between distance A and nB to align a leading edge of a sheet at the image fixing station when the movement of the continuous sheet material stops in which n is the whole integer product of distance A divided by distance B when distance A is greater than distance B and in which n is zero when distance A is less than distance B.

3. The continuous-form electrophotographic printer as defined in claim 1 wherein the sheet registration means indexes the continuous-form forward a restarting distance D that is equal to distance B minus the difference between distances A and nB to align a leading edge of a sheet at the image transfer station as the movement of the continuous-form is restarted, in which n is the whole integer product of distance A divided by distance B when distance A is greater than distance B and in which n is zero when distance A is less than distance B.

4. The continuous-form electrophotographic printer as defined in claim 2, wherein the sheet registration means indexes the continuous-form forward a restarting distance D that is equal to distance B minus the distance C to register a leading edge of a sheet at the image transfer station as the movement of the continuous-form is restarted.

5. The continuous-form electrophotographic printer as defined in claim 1 wherein the image transfer device includes a photo conductor image transport with an image receiving surface and wherein the printer further comprises a image transfer drive means operatively connected to the photo conductor image transport for moving the image receiving surface in coordination with the movement of the continuous-form to transfer images to the registered sheets.

6. The continuous-form electrophotographic printer as defined in claim 5 wherein the printer control means is operatively connected to both the sheet feeding means and the image transfer drive means for normally moving the image receiving surface and the continuous-form in synchronization with each other while the images are being transferred to the sheets and for indexing the continuous-form relative to the image receiving surface when the continuous-form is being stopped and restarted.

7. A continuous-form electrophotographic printer for printing on a continuous-form, in which the continuous-form comprises a series of interconnected individual sheets each having a sheet length B between a leading edge and a trailing edge, said printer comprising:

sheet feeding means for conveying the continuous-form initially past an electrophotographic image transfer station and then past an image fixing station;

said image fixing station being spaced downstream of the image transfer station by a preset sheet movement distance A that is different than the sheet length B;

a rotatable image transfer drum at the image transfer station for receiving electrophotographic images;

a drum drive means operatively connected to the rotatable image transfer drum for rotating the drum in coordination with the movement of the continuous-form to transfer the received electrophotographic images onto the sheets as the continuous-form is moved past the image transfer station;

an image fixing device at the image fixing station for fixing the transferred images to the individual sheets as the continuous sheet material is moved past the image fixing station; and printer control means operatively connected to the sheet feeding means and the drum drive means and having a sheet registration means that is responsive to the distances A and B and to stopping and restarting of movement of the continuous-form for (a) indexing the continuous-form relative to the image fixing station to register a leading edge of a sheet with the image fixing station when the continuous-form is stopped, and (b) indexing the continuous-form relative to the image transfer station to register a leading edge of a sheet with the image transfer drums when movement of the continuous-form is restarting.

8. The continuous-form electrophotographic printer as defined in claim 7 wherein the sheet registration means indexes the continuous-form forward a stopping distance C that is equal to the difference between distances A and nB to align a leading edge of a sheet at the image fixing station when the movement of the continuous sheet material stops, in which n is the whole integer product of distance A divided by distance B when distance A is greater than distance B and in which n is zero when distance A is less than distance B.

9. The continuous-form electrophotographic printer as defined in claim 7 wherein the sheet registration means indexes the continuous-form forward a restarting distance that is equal to distance B minus the difference between distances A and nB to align a leading edge of a sheet at the image transfer station as the movement of the continuous-form is restarted, in which n is the wole integer product of distance A divided by distance B when distance A is greater than distance B and in which n is zero when distance A is less than distance B.

10. The continuous-form electrophotographic printer as defined in claim 8 wherein the sheet registration means indexes the continuous-form forward a restarting distance that is equal to distance B minus the distance C to register a leading edge of a sheet at the image transfer station as the movement of the continuous-form is restarted.

11. In a continuous-form electrophotographic printer for printing on a continuous-form, in which the printer has: (a) sheet feeding means for conveying the continuous-form initially past an electrophotographic image transfer station and then past an image fixing station in which the image fixing station is spaced downstream of the image transfer station a preset station distance A; (b) a rotatable image transfer drum at the image transfer station for receiving electrophotographic images; (c) a drum drive means operatively connected to the rotatable image transfer drum for rotating the drum in coordination with movement of the continuous-form to transfer the received electrophotographic images onto the sheets as the continuous-form is moved past the image transfer station; (d) an image fixing device at the image fixing station for fixing the transferred images to the individual sheets as the continuous-form is moved past the image fixing station;

said continuous-form comprising a series of interconnected individual sheets each having a sheet length B between a leading edge and a trailing edge, in which the sheet length B is different than the station distance A; and printer control means operatively connected to the sheet feeding means and the drum drive means and having a sheet registration means that is responsive to the distances A and B and to stopping and restarting movement of the continuous-form for (a) indexing the continuous-form relative to the image fixing station to register a leading edge of a sheet with the image fixing station when the continuous-form is stopped, and (b) indexing the continuous-form relative to the image transfer station to register a leading edge of a sheet with the image transfer drum when the continuous-form is restarting.

12. In the continuous-form electrophotographic printer as defined in claim 11 wherein the sheet registration means indexes the continuous-form forward a stopping distance C that is equal to the difference between distances A and nB to register a leading edge of a sheet at the image fixing station when the movement of the continuous sheet material stops, in which n is a whole integer product of the distance A divided by distance B when distance A is greater than distance B and in which n is zero when distance A is less than distance B.

13. In the continuous-form electrophotographic printer as defined in claim 11 wherein the sheet registration means indexes the continuous-form forward a restarting distance that is equal to distance B minus the difference between distance A and B to align a leading edge of a sheet at the image transfer station as the movement of the continuous-form is restarted, in which n is a whole integer product of the distance A divided by distance B when distance A is greater than distance B and in which n is zero when distance A is less than distance B.

14. In the continuous-form electrophotographic printer as defined in claim 12 wherein the sheet registration means indexes the continuous-form forward a restarting distance that is equal to distance B minus the distance C to register a leading edge of a sheet at the image transfer station as the movement of the continuous-form is restarted.

15. In the continuous-form electrophotographic printer as defined in claim 11, a sheet legth input device operatively connected to the printer control means to enable an operator to enter the value of distance B.

16. In a continuous-form electrophotographic printer for printing fan-folded sheets of a continuous-form, in which each sheet has pin feed perforations along side edges, said printer having: (a) a rotatable image transfer drum at an image transfer station for receiving electrophotographic images; (b) an image fixing device at an image fixing station downstream of the image transfer station a preset station distance A for fixing the transferred images to the individual sheets as the continuous-form is moved past the image fixing station; (c) sheet feeding means having a feed tractor assembly spaced between the image transfer station and the image fixing station with drive pins for projection into the side edge perforations to convey the continuous-form initially past an electrophotographic image transfer station and then past an image fixing station; (d) a drum drive means operatively connected to the rotatable image transfer drum for rotating the drum in coordination with the movement of the continuous-form to transfer the received electrophotographic images onto the sheets as the continuous-form is moved past the image transfer station;

said continuous-form comprising a series of interconnected individual sheets each having a sheet length B between a leading edge and a trailing edge, in which the sheet length B is different than the station distance A; and printer control means operatively connected to the sheet feeding means and to the drum drive means and having a sheet registration means that is responsive to the distance A and B and to stopping and restarting signals for (a) indexing the continuous-form relative to the image fixing station to register a leading edge of a sheet with the image fixing station when the continuous-form is stopped, and (b) indexing the continuous-form relative to the image transfer station to register a leading edge of a sheet with the image transfer station when movement of the continuous-form is restarted.

17. In the continuous-form electrophotographic printer as defined in claim 16 wherein the sheet registration means indexes the continuous-form forward a stopping distance C that is equal to the difference between distances A and nB to register a leading edge of a sheet at the image fixing station when the movement of the continuous-form is stopped, in which n is the whole integer product of the distance A divided by distance B when distance A is greater than distance B and in which n is zero when distance A is less than distance B.

18. In the continuous-form electrophotographic printer as defined in claim 16 wherein the sheet registration means indexes the continuous-form forward a restarting distance D that is equal to distance B minus the difference between distances A and nB to align a leading edge of a sheet at the image transfer station as the movement of the continuous-form is restarted, in which n is a whole integer product of the distance A divided by distance B when distance A is greater than distance B and in which n is zero when distance A is less than distance B.

19. In the continuous-form continuous-form electrophotographic printer as defined in claim 17 wherein the sheet registration means indexes the continuous-form forward a restarting distance that is equal to distance B minus the distance C to register a leading edge of a sheet at the image transfer station as the movement of the continuous-form is restarted.

20. In the continuous-form electrophotographic printer as defined in claim 16, a sheet length input device operatively connected to the printer control means to enable an operator to enter the value of distance B.

* * * * *